US005380378A

United States Patent [19]

Hemsath

[11] Patent Number: 5,380,378

[45] Date of Patent: Jan. 10, 1995

[54] METHOD AND APPARATUS FOR BATCH COIL ANNEALING METAL STRIP

[75] Inventor: Klaus H. Hemsath, Toledo, Ohio

[73] Assignee: Gas Research Institute, Chicago, Ill.

[21] Appl. No.: 51,702

[22] Filed: Apr. 23, 1993

[51] Int. Cl.[6] ..... C21D 9/663

[52] U.S. Cl. ..... 148/601; 148/606; 266/256

[58] Field of Search ..... 148/601, 606, 628; 266/249, 256; 432/206

[56] References Cited

U.S. PATENT DOCUMENTS

| | | | |
|---|---|---|---|
| 1,427,319 | 8/1922 | Peacock | 266/255 |
| 2,050,029 | 8/1936 | Williams | 266/255 |
| 2,146,432 | 2/1939 | Huff | 266/255 |
| 2,201,308 | 5/1940 | Edge | 266/249 |
| 2,254,891 | 9/1941 | Germany | 266/249 |
| 2,964,307 | 12/1960 | Van Dine | 266/255 |
| 3,112,919 | 12/1963 | Gunow | 266/208 |
| 3,140,743 | 7/1964 | Cone | 266/256 |
| 3,411,763 | 9/1968 | Blackman | 266/252 |
| 3,563,522 | 2/1971 | Blackman | 266/252 |
| 3,593,971 | 7/1971 | Blackman | 432/206 |
| 3,816,901 | 6/1974 | Camacho | 431/156 |
| 4,275,569 | 6/1981 | Mayers et al. | 62/373 |
| 4,310,302 | 1/1982 | Thekdi | 266/263 |
| 4,502,671 | 3/1985 | Omura | 266/256 |
| 4,846,675 | 7/1989 | Soliman | 266/256 |
| 4,891,008 | 1/1990 | Hemsath | 432/148 |
| 5,006,064 | 4/1991 | Freund | 432/206 |
| 5,018,707 | 5/1991 | Hemsath | 266/254 |

FOREIGN PATENT DOCUMENTS

| | | | |
|---|---|---|---|
| 2082445 | 12/1971 | France | 148/628 |
| 0059456 | 3/1993 | Japan | 148/601 |

*Primary Examiner*—Scott Kastler

*Attorney, Agent, or Firm*—Frank J. Nawalanic

[57] ABSTRACT

Method and apparatus is disclosed for heat treating coiled, metal strip in bell shaped annealing furnaces employing an annealing stand upon which coils of strip are vertically stacked. An inner cover removably sealed to the stand surrounds the coil and an outer cover surrounds the inner cover. A vacuum is drawn within the inner cover while the work is being preheated to volatize oil on the coil into hydrocarbon vapors and permit the hydrocarbons to be drawn off prior to annealing so that carbon soot formation does not occur. A unique concentric, two seal arrangement is disclosed which provides for drawing a vacuum between the seals to positively seal the inner cover to the base while providing a fail safe mechanism for monitoring the process thus permitting a potentially explosive reducing atmosphere, such as pure hydrogen, to be used in the annealing furnace in a safe manner.

19 Claims, 2 Drawing Sheets

METHOD AND APPARATUS FOR BATCH COIL ANNEALING METAL STRIP

This invention relates generally to heat treating of coiled strip and more particularly to bell type furnaces for heat treating coiled metal strip.

The invention is particularly applicable to method and apparatus for batch coil annealing and will be described with particular reference to batch coil annealing of coiled steel strip. However, those skilled in the art will recognize that the invention is not necessarily limited to coiled steel strip and can be applied to other, batch type, heat treating operations performed by bell shaped furnaces on coiled metal strip.

INCORPORATION BY REFERENCE

The following patents are incorporated by reference herein so that the specification hereof need not describe matters conventionally known to those skilled in the art such as shown and described in the following patents:

| Inventor | U.S. Pat. No. |
|---|---|
| Cone | 3,140,743 |
| Blackman | 3,593,971 |
| Thekdi | 4,310,302 |
| Soliman | 4,846,675 |
| Freund | 5,006,064 |

BACKGROUND

Metal strip may be heat treated as an endless belt passing horizontally or vertically (looping tower) through a furnace after which the strip is rewound as a coil. Alternatively the strip may be heat treated in a batch furnace with the strip tightly wound as coils vertically stacked one on top of the other.

Batch coil annealing furnaces (sometimes called "box annealing furnaces" or "bell shaped" furnaces) have been long used and are well known in the industry. Basically such furnaces comprise a base upon which steel coils are stacked vertically, edge upon edge, and over which a removable inner cover is placed. (The invention is applicable to all metals. However, the discussion will be limited to annealing, cold rolled, sheet steel typically used in the automotive and appliance industries.) An outer cover in turn is placed over the inner cover. The covers are removably sealed to the base. The outer cover contains some form of heat mechanism, typically gas fired burners, which heat the inner cover, and the inner cover in turn radiates the heat to the work. Batch coil annealing processes in the steel mill industry typically take anywhere from about 20 hours to as long as several (3) days to complete.

Traditionally, continuous strip annealing process has been viewed as superior to the batch annealing process on a quality or quality controlled basis. Substantively, it is believed that the work quality gap between the two processes was narrowed significantly with the introduction of pure hydrogen into the inner cover during the heating stage for a variety of chemical and metallurgical reasons which will not be set forth in detail nor commented on further herein since the present invention does not claim to have invented the use of hydrogen in the batch coil annealing process. At the same time however, the use of hydrogen in the steel mill environment raises serious safety concerns since any mixing of hydrogen with oxygen at standard atmospheric pressure will produce a highly combustible gas mixture.

Because of safety concerns, after the coils are placed on the base and covered with the inner cover and while the work is being heated to its annealing transformation temperature, the air has to be purged from the annealing cover. If the annealing system is using some hydrogen-nitrogen atmosphere gas, i.e., an HNX TM gas, a number of volume changes of atmosphere must be employed before heating at elevated temperatures can occur. If a pure hydrogen atmosphere is to be used purging will take even longer and be more expensive. When pure hydrogen is used, the base must first be completely purged with an inert gas such as nitrogen before a switch to hydrogen is made. This is why in some systems which use hydrogen-nitrogen atmospheres, the hydrogen to nitrogen ratio becomes increasingly shifted to hydrogen as the process continues. Further when pure hydrogen systems are used, once the heating is accomplished, full cooling with air at ambient temperature can not take place until the hydrogen has been purged or diluted with an inert gas such as nitrogen. In general summary, the use of hydrogen enhanced the product quality of strip which has been annealed in a coiled state, but the cycle time was lengthened and the process cost increased because of the additional cost required to supply the inert, purged gas. Though nitrogen is a relatively inexpensive gas, the gas volume used within the cover and the number of gas changeovers required does constitute an economic process concern or consideration.

Apart from process considerations relating to gas expense and process time, there is the overriding safety concern to produce an effective furnace seal given the explosion potential resulting from the use of hydrogen, especially pure hydrogen, as a convective, furnace atmosphere during the annealing process. Traditionally, sand seals have been used to effect sealing of bell shaped furnaces. The sand seal (or conceptually, a water trough) is not acceptable as a seal between the base and the inner cover (The seal between the outer cover and the base is not critical and any conventional seal, including sand, can be used). Ceramic seals such as ceramic braid or ceramic blankets do not offer the consistent seal reliability necessary for use with pure hydrogen systems. By the process of elimination, this leaves elastomer seals as the type of seal which has the inherent sealing characteristics needed for the hydrogen application under discussion. Examples of prior art elastomer seal arrangements are set forth in Blackman U.S. Pat. No. 3,593,971; Freund U.S. Pat. No. 5,006,064 and Soliman U.S. Pat. No. 4,846,675. Though the seal arrangements discussed in the prior art patents will work, they will not consistently work over a long period of time and require frequent maintenance and replacement.

Separate and apart from any of the problems discussed above, cold rolled steel strip and sheet contain small amounts of rolling oils that cannot be completely removed with conventional equipment. Traces of rolling oil adhere to the steel surfaces in a tight and thin film. When the steel surfaces are then heated in the batch coil annealing process, the oil begins to evaporate and the oil vapors mixed with the recirculated heat transfer medium which, as discussed above, will consist of either an inert gas such as nitrogen, pure hydrogen, or any mixture of hydrogen and nitrogen. The oil vapor and the oil vapor mixture causes several secondary processes to take place with respect to the steel or base metal which are detrimental to the quality of the coil surfaces and have other operational disadvantages. The most detrimental effect is the deposition of carbon soot on the coil or sheet surfaces. This soot negatively affects paint adherence and surface cleanliness. Soot deposits are therefore closely controlled by the steel customer to assure a clean coil surface that can be readily painted after cleaning with a conventional phosphate wash. An example of such requirement is Ford Motor Company's engineering material specification ESB-M2P117-A entitled "Paint, Steel, Surface Cleanliness-Exterior" which limits soot deposits to less than 0.65 milligram per square foot.

After prolonged operation a typical coil annealing stand which, as noted above, includes an inner cover and a base becomes normally covered with significant amounts of soot and that soot is oily in areas of lower wall temperatures. Heretofore, several equipment suppliers have claimed that their equipment was capable of removing soot from coil surfaces. However, the experience of steel manufacturers has been that such surface cleanliness is difficult to replicate in a consistent manner. At present, the most reliable of all such techniques designed to eliminate or minimize soot or soot formation have proposed to rid the system of the soot or prevent the soot from forming in the first instance by soot oxidation. Suit oxidation is achieved by using small amounts of steam in a base of high hydrogen content atmospheric gas. The problem with this method (i.e., causing soot oxidation by steam) is the tight control of atmosphere composition which must be exerted to prevent surface oxidation of steel or, in the case of alloyed steels, to avoid intergranular oxidation of alloying elements. The oxidation method is, therefore, dependent on close control of the partial pressure of water vapor which must be measured and which can be determined by measuring the dew point of the recirculating atmosphere gas.

That is, soot formation and soot oxidation can take place only at rather high temperatures. The equilibrium value of the heterogeneous reaction of carbon with steam is close to unity at a temperature between 1220° F. and 1270° F. This means that a large excess of hydrogen at this temperature will also require a large amount of water vapor to form any appreciable amount of carbon monoxide. Removal of carbon monoxide at high temperatures and reduction of water vapor at lowered temperatures is very important or critical to complete removal of soot while preventing oxidation of steel surfaces. Very close control of surface temperature and gas composition is therefore required to obtain the desired, expected results. In fact, only a complicated or complex control system with feedback control of residual carbon monoxide concentration in the recirculating gases can assure clean steel surfaces.

SUMMARY OF THE INVENTION

Accordingly, it is a principal object of the invention to provide method and apparatus for batch coil annealing of coil strip which prevents or minimizes sooting or carbon deposition within the coils when the coils are subjected to an annealing process.

This object along with other features of the invention is achieved in a batch coil annealing process for annealing cold rolled strip which includes the steps of:

a) vertically stacking coils of coiled strip onto a base and covering the coils with an inner cover seal to the base;

b) heating the cover to, in turn, heat the coils to a preheat temperature of at least about 500° F.;

c) drawing a vacuum at a predetermined vacuum level within the cover while the coils are being heated to vaporize oils and hydrocarbon deposits within the cover and exhaust the same from the cover;

d) condensing the vaporized hydrocarbons into liquid outside the cover for collecting and removing same and thereafter;

e) heating the coils to their annealing temperature whereat the strip will be annealed without substantial carbon sooting or deposition within the coils taking place.

In accordance with another aspect of the invention, while the coiled strip is being heated and maintained at its batch coil annealing temperature, a treatment gas, which in the preferred embodiment comprises substantially pure hydrogen, can be backfilled into the inner cover for atmosphere recirculation as taught by conventional methods. However, the additional step of again drawing a vacuum can be performed for a periodic purging of the hydrogen atmosphere or a portion thereof from the inner cover during the time period the inner cover heats the coils at their transformation temperature, whereby the overall process time is reduced and/or quality is enhanced. Significantly, the withdrawn atmosphere while under a vacuum is not capable of combustion and is in turn mixed with an inert atmosphere or diluted with an inert gas to produce a gaseous mixture not capable of sustaining or supporting combustion when exposed to oxygen at standard atmospheric pressures.

In accordance with still yet another specific feature of the invention, the invention contemplates a cyclic application of steps "c" and "d." The repeated purging of hydrogen or HNX from the space between adjacent wraps will remove oil vapors and will ascertain or assure that no undesired compounds are left at the end of the purge. Filling the space between adjacent wraps with hydrogen by evacuating the wraps and repressurizing same with clean hydrogen will assure removal of undesired compounds in a far superior manner than that which could be accomplished by conventional purging at atmospheric pressure.

In accordance with another important aspect of the invention, the process also includes the step of providing an inner cover with an annular flange resting on the base to sealingly compress first and second generally circular, generally concentric elastomer seals within and between the flange and the base. The process further includes the steps of drawing a vacuum within the annular sealing space between the first and second seals with the vacuum in the sealing space always maintained higher than that vacuum drawn within the cover and sensing the makeup of any gas seepage within the annular sealing space so that the annealing process can be stopped should a predetermined quantity of detrimental atmosphere gas leak past either of the seals. In conjunction with this feature of the invention, the inventive process also includes in the event that the atmosphere gas sensed is hydrogen or hydrogen and air, an additional step of providing a supply of inert gas and admitting and mixing the inert gas with the hydrogen (or hydrogen and air) gas withdrawn is completed. This mixing of inert gas is at a rate or volume quantity coordinated with the vacuum drawn in the annular sealing space sufficient to dilute the hydrogen with the mixed inert gas to produce a diluted gas mixture unable to sustain or support combustion when the mixture is exposed to atmosphere whereby the sealing process employed allows the batch coil annealing process to continue notwithstanding the fact that an inadvertent, nominal leakage pass one or both elastomer seals may have occurred.

In accordance with another aspect of the invention a process for batch coil annealing a plurality of coils of metal strip is provided which includes the steps of i) stacking a plurality of coils on the base and covering the coils with a removable inner cover sealed to the base with the inner cover in turn positioned within an outer, removable cover;

ii) heating the inner cover to, in turn, heat the coils stacked one on top of the other within the inner cover, until the coils are a temperature whereat the annealing process can be performed then a) drawing a predetermined vacuum within the inner cover followed by b) introducing a process gas into the inner cover while maintaining the inner cover at a second predetermined vacuum level, and c) periodically performing steps a and b during the batch annealing cycle to reduce the overall cycle time.

In accordance with another aspect of the invention, batch coil annealing apparatus is provided which includes a stationary base upon which coils of metal strip are stacked. The base has an annular seating surface circumscribing the coils and first and second annular, generally concentric, sealing grooves formed within the annular sealing surface. A removable, thin walled, cylindrical, inner cover receives the coils. The inner cover has a longitudinally extending cylindrical section with a closed axial end and an open axial end, in turn, having an annular flange extending radially outwardly from the open end. The annular flange has first and second annular, generally concentric sealing grooves, with the first and second flange sealing grooves having the same diameter as the first and second base sealing grooves respectively. A removable outer cover surrounds the inner cover and a seal arrangement for removably sealing the outer cover to the base is provided. First and second elastomer seals are provided with the first elastomer seal disposed in the first base groove and the first flange groove and the second elastomer seal disposed in the second base groove and the second flange groove and a mechanism to draw a sealing vacuum in the annular sealing space between the first and second elastomer seals forces inner cover to be positively sealed to the base. The seal arrangement can be used whether or not the atmosphere within the inner cover is at a vacuum or at positive pressures.

However, in accordance with another separate aspect of the invention the apparatus further includes a mechanism to admit and mix an inert gas with the gas withdrawn from the annular seal space and a microprocessor is provided to control the vacuum level within the annular seal space so that the quantity of inert gas mixed with the withdrawn gas is sufficient to prevent formation of a gas mixture which can sustain combustion when exposed to oxygen.

In accordance with still another aspect of the invention, a heat mechanism is provided to heat the inner cover to in turn heat the coils stacked on the base and the microprocessor controls the heat mechanism so that the work is heated to a temperature of no more than about 500-600° F. while a vacuum is drawn within the inner cover whereby oil and other hydrocarbons are withdrawn as a vapor from the inner cover.

It is thus an object of the invention to provide a method and apparatus for positively sealing the inner cover to the base of a batch coil annealing furnace.

It is another object of the invention to provide a batch coil annealing process in which a vacuum is periodically pulled or drawn within the inner cover while the work is heated to the annealing transformation temperature to produce improved annealed product and/or shortened cycle times.

It is another object of the invention to provide method and apparatus for producing improved product from batch coil annealing furnaces or furnaces utilizing batch coil annealing process.

Still yet another object of the invention is to provide shortened cycle times for a batch coil annealing process.

Still yet another object of the invention is to provide a long lasting, durable seal arrangement for batch coil annealing furnace.

Another object of the invention is to provide a control mechanism to produce in a batch coil annealing furnace an improved product and/or shortened cycle time.

Still yet another object of the invention is to provide method and apparatus for removing oily deposits from cold rolled steel so as to avoid carbon formation during the batch coil annealing process in a simple, easily controlled process.

Yet another object of the invention is to provide a shortened batch coil annealing process while at the same time preventing carbon or soot formation on the annealed strip or sheet thus producing improved strip or sheet product.

Another object of the invention is to provide a seal arrangement for a batch coil annealing furnace which permits the furnace to safely use explosive reducing gases during the annealing process.

These and other objects of the invention will become apparent to those skilled in the art upon reading and understanding the detailed description of the invention set forth in the section below.

BRIEF DESCRIPTION OF THE DRAWINGS

The invention may take physical form in certain parts and arrangements of parts, preferred and alternate embodiments of which will be described in detail in this specification and illustrated in the accompanying drawings which form a part hereof and wherein.

DETAILED DESCRIPTION OF THE INVENTION

Figure 1:
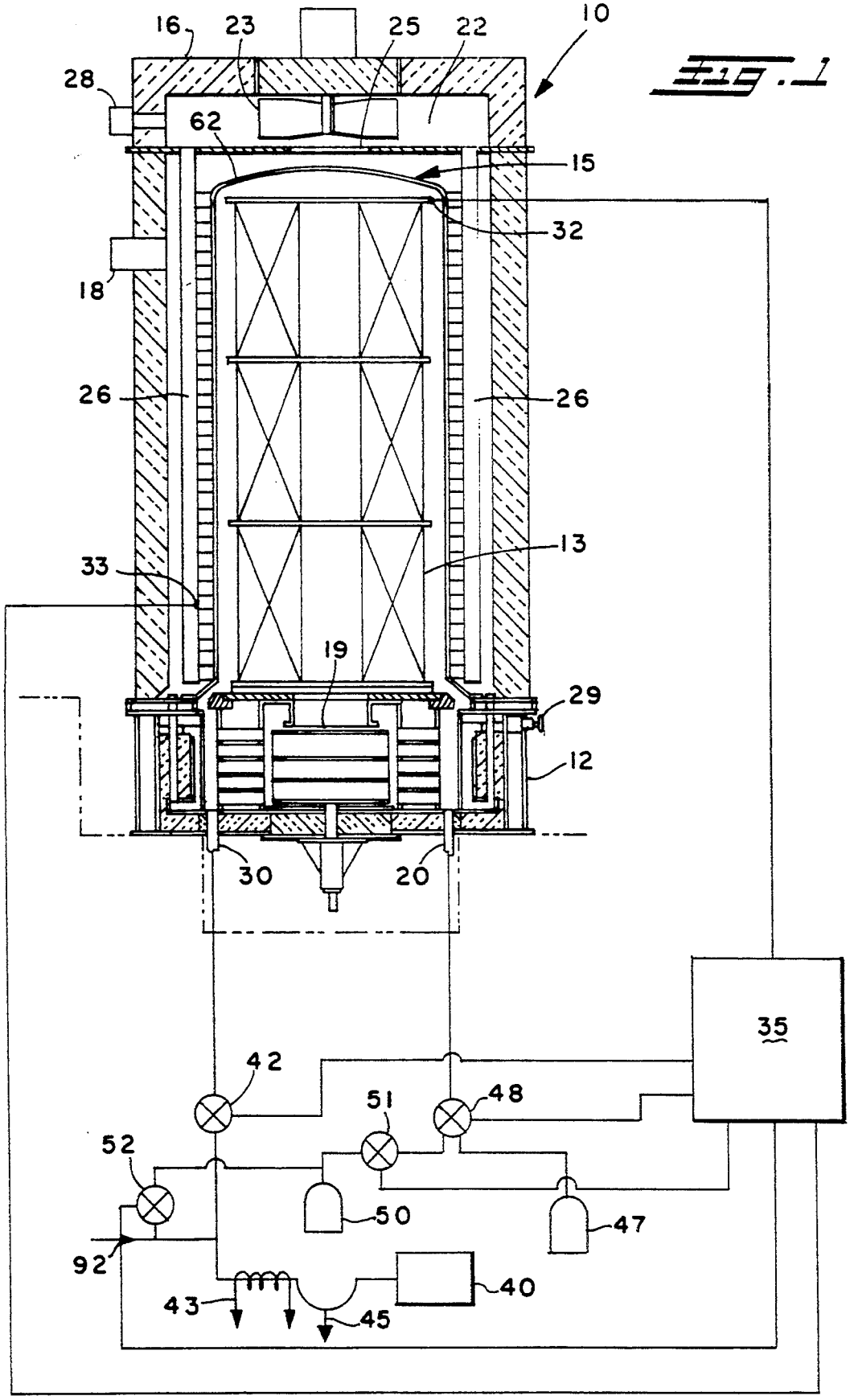
FIG. 1 is a schematic plan, sectioned view of the batch coil annealing furnace of the present invention

Referring now to the drawings wherein the showings are for the purpose of illustrating a preferred embodiment of the invention only and not for the purpose of limiting the same, there is shown in FIG. 1 in schematic form a bell shaped annealing furnace 10. Annealing furnace 10 includes an annealing stand on base 12 which is fixed or stationary and upon which a plurality of coils 13 of metal strip are stacked on edge vertically as shown in FIG. 1. Enclosing or covering strip coils 13 is a sealable, removable inner cover 15. Covering or enclosing inner cover 15 is a sealable, removable outer cover 16.

Outer cover 16 carries a heating mechanism, typically a gas fired burner 18 which is used to heat the outside surface of inner cover 15 which in turn radiates heat to coil strips 13. Annealing stand 12 generally includes an axial base fan 19 for cooling the work or coils 13 and base fan 19 also is used for convectively heating the coils 13 by movement of atmosphere within inner cover 15 while the work or coils 13 is being heated to its annealing temperature. Further, a gas inlet (outlet) 20 is provided for introducing a furnace atmosphere into inner cover 15 during the annealing process. As indicated above in the general discussion, the furnace atmosphere can be either inert, hydrogen or some combination of hydrogen and inert i.e., HNX TM . The apparatus as thus far described is entirely conventional.

Annealing furnace 10 illustrated in FIG. 1 is shown to also include some additional features which do not necessarily form a part of the invention described herein but nevertheless are illustrated in schematic form in FIG. 1. Thus in FIG. 1 outer cover 16 is closed to form a plenum chamber 22 housing an outer cover fan 23. Outer cover fan 23 pulls atmosphere within outer cover 16 through a central opening 25 in plenum chamber 22 and forces the furnace atmosphere into axial ends of a plurality of longitudinally extending distribution pipes 26 which are circumferentially spaced about plenum chamber 22. The furnace atmosphere exits the distribution pipes 26 through small orifice jets that impinge against inner cover 15 with the spent jets being drawn back into plenum chamber 26 through the under pressure zone (i.e., central opening 25) established from rotation of cover fan 23. Burner 28 provides additional heat input for heating the outer cover atmosphere. In this way additional heat input can be applied to inner cover 15 and also additional cooling imparted to inner cover 15. In addition to the modification of outer cover 16, annealing base 12 includes several modifications one of which is the addition of a base burner 29 and another one of which is the addition of a vacuum inlet 30. It should be clear to those skilled in the art that vacuum inlet 30 will function as a gas outlet for gas inlet 20.

As discussed above, operating annealing furnace 10 proceeds by first vertically stacking coils of wound strip onto an exposed base 12. The coils are separated edgewise from one another by a diffuser plate inserted between the top edge of one coil and the bottom edge of an adjacent coil. The diffuser plate provides radial passages for flow of furnace atmosphere over the exposed axial ends or edges of adjacent coils. Once coils 13 are stacked on base 12, inner cover 15 is lifted into place and sealed to base 12. Heretofore there were a number of ways to removably seal inner cover 15 to base 12. Also fitting over inner cover 15 is outer cover 16 which is likewise removably sealed to base 12 by any one of a number of conventional seal arrangements. Conventional prior art seal arrangements are disclosed in Van Dine U.S. Pat. No. 2,964,307; Blackman U.S. Pat. Nos. 3,563,522; 3,411,763; 3,593,971; Soliman U.S. Pat. No. 4,846,675; and Freund U.S. Pat. No. 5,006,064.

The annealing process is entirely conventional. As well known by those skilled in the art, annealing is employed to impart softness, machinability, and metalworking properties of the metal by removing stresses previously imparted to the metal, usually by previous cold rolling operations in which the metal is stressed and work hardened. Conceptually, the coils are heated to a temperature slightly above the transformation critical temperature range (i.e., about 1268° F.) and the coils are held at this temperature until the coils have been uniformly heated to the transformation temperature whereat they are then cooled, generally speaking in a relatively slow manner (as opposed to a quench). As indicated above, cycles times vary anywhere from about 20 hours to several days. The object, of course, is to heat the work uniformly (so as not to radically or excessively exceed the transformation temperature and proceed to make coarse the grain of the base metal) and then cool the work as rapidly as possible to minimize the cycle time. Now as indicated above, it is conventional practice, at least with respect to annealing steel strip, that the furnace atmosphere at the transformation temperature is to be devoid of oxygen. This means that the furnace atmosphere when the work is at the transformation temperature is to be either inert i.e., nitrogen or is to be a reducing atmosphere i.e., hydrogen (carbon monoxide, etc.). It has been determined that there are benefits to be obtained in using a reducing atmosphere such as hydrogen in batch coil annealing of steel strip. Accordingly, batch coil annealing processes, as discussed above, use either an inert gas, or a gas which is completely comprised of hydrogen or a gas which is comprised of hydrogen and nitrogen. Further, it has been known to vary the makeup of the furnace atmosphere gas during the furnace cycle so that the HNX gas composition will vary from one which has a significant quantity of nitrogen at the beginning of the cycle to one which is composed almost principally of hydrogen at the end of the cycle. When hydrogen is used, and while the work is being heated, the furnace or the space within inner cover 15 must be purged. For strictly definitional purposes, one purge is equal to one volume changeover or is the volume of gas at standard atmospheric pressure which is needed to completely fill the inner cover. Standard operating practices using hydrogen gas require that there be anywhere from five to eight purges of inner cover 15 with an inert gas such as nitrogen until inner cover 15 has been deemed to be suitably purged to the point where hydrogen can be admitted into inner cover 15.

It will of course be readily understood by those skilled in the art that should oxygen be present within inner cover 15, the introduction of pure hydrogen will result in a mixture capable of sustaining combustion or explosion. Accordingly, all steps must be taken when using hydrogen to prevent oxygen from being present within inner cover 15 when hydrogen is introduced assuming that standard atmospheric pressure exists within inner cover 15 i.e., the current operating conditions conventionally existing today. It will of course be appreciated by those skilled in the art that should a vacuum be drawn within inner cover 15, the percentages of hydrogen and oxygen needed or necessary to support combustion (if combustion can be supported at all) will dramatically change. Thus, pulling or drawing a vacuum within inner cover 15 allows or permits, some tolerance of oxygen within inner cover 15 which is not otherwise present in conventional bell shaped annealing furnaces 10. Apart from what happens inside inner cover 15, it will of course be clear to those skilled in the art that leakage of the hydrogen from within inner cover 15 to the outside air surrounding outer cover 16 is a completely unsafe condition. Because of the possibility of an explosion from leakage of hydrogen from within inner cover 15 to the ambient air surrounding bell shaped furnace 10, many facilities will only anneal using an inert gas which is nitrogen with a very low percentage of hydrogen for the protective atmosphere. This does result, or is at least believed to result, in longer cycle times in what otherwise could be produced should the atmosphere within inner cover 15 consist only of hydrogen.

The operation then with inner cover 15 and outer cover 16 installed on top of base 12 is to purge inner cover 15 while heating inner cover 15 vis-a-vis outer cover 16 so that when higher temperatures are reached at which steel tends to oxidize, an entirely inert, or a reducing or an inert-reducing atmosphere is present within inner cover 15. After the coils have been soaked for an appropriate time at the annealing temperature and after cooling is about complete, hydrogen is again purged from the system and air is introduced to achieve rapid cooling or convective air cooling vis-a-vis annealing base fan 19. Again, if hydrogen or a reducing atmosphere is used, prior to introducing the ambient air, inner cover 15 must be thoroughly purged again with an inert gas such as nitrogen.

Generally speaking, the process can and is controlled by an inner cover thermocouple 32 measuring temperature of the atmosphere within inner cover 15 and an outer cover thermocouple 33 measuring temperature within outer cover 16. The readings are recorded and stored in a microprocessor controller schematically illustrated by reference numeral 35 which in turn controls firing of burner 18 and also the admission of process gas through gas inlet 20 in inner cover 15.

The invention also includes the provision of a vacuum pump 40 connected to vacuum inlet 30 vis-a-vis a vacuum valve 42 under the control of microprocessor controller 35. Vacuum pump 40 includes a heat exchanger schematically illustrated by reference numeral 43 for cooling the contents within a vacuum line and a condensate drain or tap 45. The system also includes a source of hydrogen or reducing gas 47 connected to gas inlet 20 through hydrogen valve 48 under the control of microprocessor controller 35. Again, it will be clear to those skilled in the art that hydrogen 47 is under a source of positive pressure which is metered or controlled when admitted into interior of inner cover 15 through hydrogen valve 48. Similarly, a source of inert gas such as nitrogen, schematically illustrated by reference numeral 50 is likewise in fluid communication with gas inlet 20 through control of nitrogen valve 51. Nitrogen valve 51 likewise is under the control of microprocessor 35.

As noted above, cold rolled, coiled strip or sheet contains small amounts of rolling oil. At high temperature (i.e., transformation temperature) carbon, more specifically carbon soot, is formed when the oil is pyrolyzed at standard atmospheric pressure. Now it is known that at higher temperatures such as about the transformation temperature i.e., 1220–1270° F., steam will react with the oil, hydrocarbon and carbon in a ratio of almost one to one to produce carbon monoxide. This means then that there must be a large excess of hydrogen at the temperature range of between 1220–1270° F. and also there must be a relatively large amount of water vapor so that an appreciable amount of carbon monoxide can be formed from the process gas used in bell shaped annealing furnace 10.

An alternative way to remove the carbon is to remove the oil vapors before they have a chance to polymerize and pyrolize. In order to accomplish this, the oil must first be evaporated from the steel surface into an oil vapor and then the oil must be removed from the gases into which it is evaporated into. For example, lowering the absolute pressure within inner cover 15 and base 12 from atmospheric pressure to one millibar pressure will reduce the boiling point of a typical rolling oil by approximately 250° F. This means that an oil fraction that would normally evaporate at 750° F. under standard atmospheric pressure would at the lower absolute pressure, result in a lower, new boiling point temperature of about 500° F. This reduction of boiling points will result in substantially lower evaporation temperature levels throughout the entire system and will not lead to premature soot formation as long as all exposed surfaces are still at their sufficiently low temperature. Note that it is preferred that the oil vapor be removed from the system before resuming heating to the higher temperatures. In other words the heat up is stopped when the strip reaches its 500 to 600° F. temperature, until all the hydrocarbons have been withdrawn. One way to do this effectively (i.e., simultaneously lower the absolute pressure in the system to remove the oil vapors) is to connect the entire batch coil annealing stand to vacuum pump 40 as shown. By further adding the equivalent of a cold trap 45 in between pump 40 and batch coil annealing furnace 10, the oil vapors drawn out from the atmosphere being evacuated from inner cover 15 can be condensed by heat exchanger 43 and can be recovered at trap 45 as shown.

One of the overriding benefits of the invention thus results from recognizing that the boiling temperature of any substance is dependent on the absolute pressure. Any decrease in pressure is accompanied by an attendant decrease in the boiling temperature. Further, boiling results in enhanced mass transfer and removal of oils at a greatly accelerated rate. Thus, complete removal of oil vapors can be achieved not only faster but also at lower temperatures. Polymerization, pyrolysis and soot formation all occur at certain absolute temperature ranges and by removing all oil before any of these reaction temperatures are reached or exceeded, it becomes possible to avoid soot formation and fouling of steel surfaces.

Apart from the process advantages inherently achieved by cleaning or deoiling the surfaces in the preheat step by use of the vacuum system, there are other advantages which can be gained at any time by the presence or the ability of vacuum pump 40 to draw a precisely controlled vacuum within inner cover 15 at any time during the batch annealing process. Thus, at the transformation temperature, it now is possible without the necessity of constant purging of a nitrogen based gas, to simply pull water vapor as well as the carbon vapors out of the furnace so that within inner cover 15 a vacuum or partial vacuum is drawn and into which space (space of inner cover 15) some amount of a reducing gas i.e., pure hydrogen (or alternatively, a percentage of hydrogen and nitrogen) can be introduced to achieve the benefits of hydrogen batch coil annealing. When the hydrogen through source 47 is admitted by valve 48, a backfilled pressure is thus experienced within the space of inner cover 15. This raises the pressure or reduces the vacuum within inner cover 15. Conceptually, it is possible to raise the pressure to or above standard atmospheric pressure. Thus, during the annealing process, the vacuum within inner cover 15 is regulated through valve 42 so that the pressure within inner cover 15 can range anywhere from standard atmospheric pressure to a vacuum of more than 760 Torr or 1000 millibar which can be controlled and positively so in accordance with a preprogrammed cycle or in accordance with measurable temperature events from thermocouple 32 vis-a-vis microprocessor controller 35. Inherently, by drawing a vacuum within inner cover 15 while coils 13 are at the transformation temperature, results in diffusion of the hydrogen throughout all the tiny spaces within wraps of strip or sheets of coils 13 thus enhancing the benefits of the hydrogen resulting in better process control in a time period which is believed to be shorter than that which otherwise would be achieved in the prior art positive pressure systems. Because the hydrogen gas is withdrawn through vacuum inlet 30 a second inert valve 52 deletes or adds an inert gas to the hydrogen being withdrawn prior to condensation or removal of the gas to produce a non-combustible mixture when the gas is exposed to standard atmospheric pressure.

Figure 2:
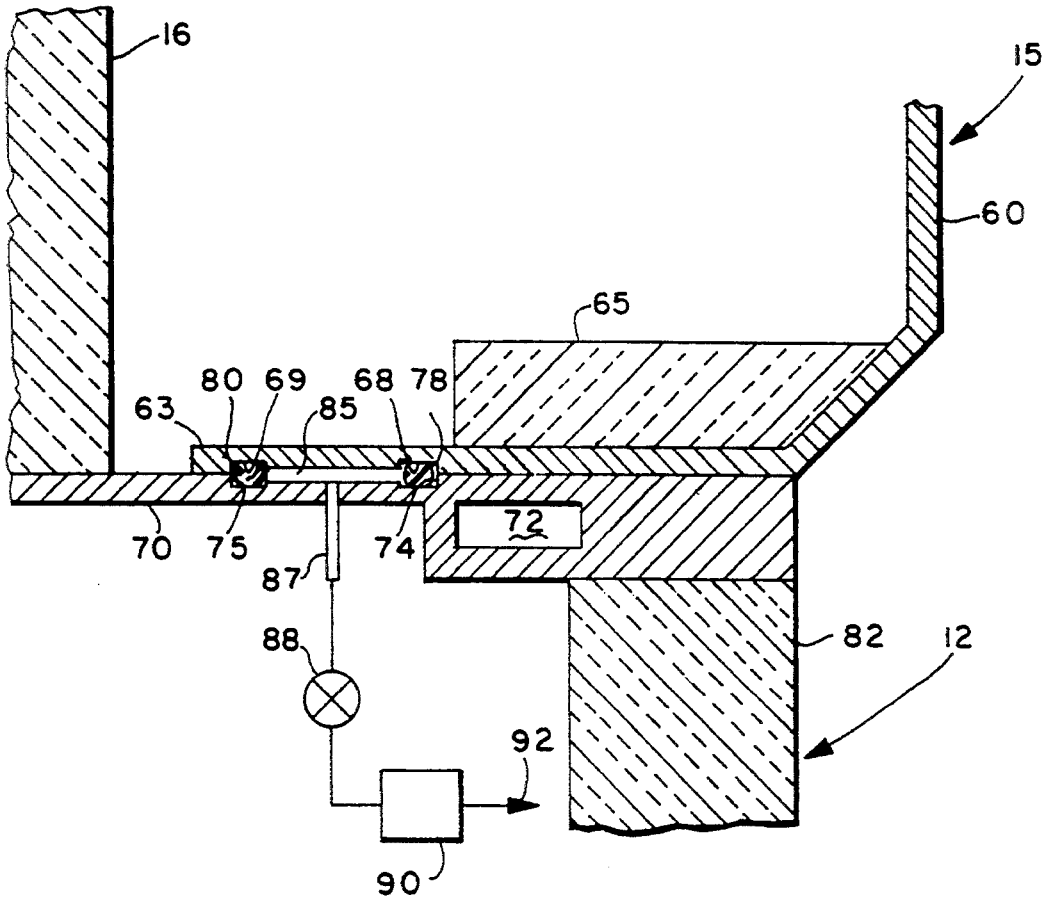
FIG. 2 is a blown up, schematic, sectioned view of a portion of the furnace shown in FIG. 1 illustrating the sealing arrangement employed in the invention.

It is of course absolutely necessary that inner cover 15 be positively sealed in a removable manner to annealing stand or base 12. Annealing cover 15 can be best described as having a longitudinally extending cylindrical section 60 having a closed spherical end 62 at one side and an open annular flange 63 (FIG. 2) at its opposite side. Adjacent the intersection of annular flange 63 with longitudinally extending cylindrical section 60 is insulation 65. Spaced radially outwardly from insulation 65 is a first annular O-ring groove 68 and spaced further radially outwardly a second annular O-ring groove 69. Annular flange 63 rests on an annular base mounting surface 70. Annular base mounting surface is provided with a water jacket shown by reference numeral 72 (FIG. 2) through which a cooling medium such as water continuously flows from an inlet to an outlet (not shown). Concentric with first annular O-ring groove 68 and spaced radially outwardly from water jacket 72 is a first annular base O-ring groove 74. Similarly, concentric with and spaced radially outwardly from first base O-ring groove 74 is a second base O-ring groove 75. Contained within first O-ring grooves 68, 74 is a first, conventional, elastomer O-ring 78 and contained within second O-ring grooves 69 and 75 is a second O-ring 80. The weight of inner cover 15 resting on base seating surface 70 in and of itself is sufficient to sealingly compress first and second O-ring seals 78, 80. Water jacket 72 is sufficient to prevent the temperature of flange 63 and base mounting surface 70 from rising to a temperature whereat O-ring seal deformation will occur. Cooling is enhanced by the positioning of insulation 65 relative to the inner cover annular flange 63 and also the positioning of insulation material 82 relative to annular base mounting surface 70. For drawing clarity purposes, the annular space radially extending in between first and second O-rings 78, 80 is shown relieved to define an annular sealing space 85 (although no relief in fact is necessary). The point is that a vacuum inlet 87 connected through a seal valve 88 under the control of microprocessor controller 35 is effective to draw a vacuum within annular seal space 85. The vacuum drawn in annular space 85 assures that annular flange 63 will be drawn down against annular base mounting surface 70 to assure a positive seal at first and second O-ring seals 78, 80. (To prevent lockup, annular seal inlet 87 can be subjected to a positive pressure after the annealing process is completed and inner cover 15 is to be removed.) Annular seal inlet 87 downstream of valve 88 is connected to a conventional residual gas analyzer indicated by reference numeral 90. Residual gas analyzer 90 or any other similar device analyzes composition of the gas withdrawn from annular space 85. More specifically, if a leakage occurred at second annular seal 80, oxygen or air could leak into annular space 85 (Note oxygen can find its way into the space between outer cover 16 and inner cover 15 either by leakage of ambient air past outer cover 16 relative to the seal which is not shown in the drawings between outer cover 16 and annular base mounting surface 70. Outer cover 16 seal could be any of the elastomer seals such as shown in Blackman U.S. Pat. No. 3,411,763; Blackman U.S. Pat. No. 3,593,971; Blackman U.S. Pat. No. 3,563,522; Freund U.S. Pat. No. 5,006,064; or Soliman U.S. Pat. No. 4,846,675.) Alternatively, oxygen can exist in the space between outer cover 16 and inner cover 15 and leak past second seal 80. Also, the atmosphere within inner cover 15, for example hydrogen, can leak past first O-ring seal 78 into annular seal space 85. Now importantly, because a vacuum is drawn in annular seal space 85, it is not possible for an explosive mixture of air or hydrogen to exist within annular seal space 85 to cause an explosion. Again, this is because a vacuum is drawn in annular seal space 85. Secondly, the residual gas analyzer 90 senses which of the seals, if any, or alternatively, if both have developed any leakage and that signal is outputted to microprocessor controller 35 which in turn regulates or meters the amount of inert gas 50 which is mixed by valve 52 with the mixture being withdrawn from annular seal space 85 to prevent any explosion once the mixture is vented to standard atmospheric pressure and too, the pumping or the vacuum pulled by pump 40 vis-a-vis valve 48 is controlled so that, should the leakage increase, vacuum or the vacuum output of the pump is increased to always maintain a vacuum in annular seal space 85. The vacuum within annular seal space 35 is always greater than the vacuum pulled within inner vacuum cover 15. The vacuum in space 85 also provides an added, free benefit. It provides a significant hold down or compressive force which can easily approach several tons over a large vacuum area- Typically a four inch (4") vacuum space would provide about 1000 square inches of area and a hold down force of approximately 15,000 pounds (14.7 psi) or 7.5 tons.

The invention has been described with reference to a preferred embodiment. Modifications and alterations will occur to those skilled in the art upon reading and understanding the invention as described above. It is intended to include all such modifications and alterations in-so-far as they come within the scope of the invention.

Having thus described the invention, it is now claimed:

1. A batch coil annealing process for annealing cold rolled strip comprising the steps of:

a) vertically stacking coils of rolled strip onto a base and covering said coils with an inner cover sealed to said base;

b) heating said cover to, in turn, heat said coils to a preheat temperature of at least about 500° F.;

c) drawing a vacuum within said cover while said coils are being heated to vaporize oils and other hydrocarbon deposits within said cover and exhaust same from said cover;

d) condensing said vaporized hydrocarbons into liquid outside said cover for collecting and removing same; and thereafter;

e) backfilling said cover with a treatment gas composed substantially of hydrogen while said coils are heated to their annealing process transformation temperature, said vacuum within said cover decreasing to as little as standard atmosphere pressure or above when backfilled with said treatment gas; and f) periodically increasing the vacuum within said cover followed by periodic introduction of said treatment gas into said cover whereby the cycle time of said annealing process is reduced.

2. The batch coil annealing process of claim 1 wherein said treatment gas is comprised solely of hydrogen.

3. The batch coil annealing process of claim 1 wherein said cover has a horizontal annular flange resting on said base, and first and second generally circular, generally concentric, elastomer seals within and between said flange and said base, and said process further includes the steps of a) drawing a vacuum within the annular seal space between said first and second seals, said annular seal space always maintained at a vacuum higher than that vacuum drawn within said cover; and b) sensing the make-up of any gas seepage within said annular seal space so that said annealing process is stopped should a detrimental quantity of inner cover atmosphere gas or air leak past either of said seals.

4. The batch coil annealing process of claim 3 wherein in the event said gas sensed in said seal space is atmospheric air then, said vacuum drawing step in said annular seal space is controlled to assure that a vacuum at a first vacuum level sufficient to draw all atmospheric air out of said seal space exists whereby said process continues until completion without concern that atmosphere air will enter said inner cover.

5. The batch coil annealing process of claim 3 wherein in the event said atmosphere gas sensed is hydrogen then the method includes the additional steps of providing a supply of inert gas and admitting and mixing said inert gas with said hydrogen gas withdrawn from said annular seal space at a rate coordinated with the vacuum drawn in said annular seal space sufficient to dilute said hydrogen with said inert gas to produce a diluted gas mixture unable to sustain or support combustion when exposed to oxygen at standard atmospheric pressure.

6. The batch coil annealing process of claim 3 wherein should said gas sensed in said seal space be a mixture of hydrogen and air, said process including the additional steps of providing a supply of inert gas and admitting and mixing said inert gas with said hydrogen and air withdrawn from said seal space under vacuum at a rate coordinated with the vacuum drawn in said annular seal space sufficient to dilute said hydrogen and air with a sufficient quantity of said inert gas to produce a diluted gas mixture unable to sustain or support combustion when subsequently exposed to further quantities of oxygen at standard atmosphere pressure.

7. The batch coil annealing process of claim 2 wherein said treatment gas is heated to an elevated temperature prior to being admitted into said inner cover.

8. The batch coil annealing process of claim 7 wherein said treatment gas includes some components of or all products of combustion produced by gas fired burners.

9. The batch coil annealing process of claim 8 further including said base having a fan and said fan causing atmosphere within said cover to circulate about said coils when said atmosphere is backfilled into said cover.

10. The batch coil annealing process of claim 1 wherein the atmosphere within said cover prior to heating said coils to said preheat temperature is air, said air being evacuated from said cover during said preheating step and thereafter filling said cover only with a treatment gas having a substantial hydrogen composition which composition substantially does not change during the annealing process whereby conventional purging and change over process gases are eliminated.

11. The batch coil annealing process of claim wherein said treatment gas is heated to an elevated temperature prior to being admitted into said inner cover.

12. The batch coil annealing process of claim 11 wherein said treatment gas includes products of combustion exhausted from gas fired burners.

13. The batch coil annealing process of claim 1 further including said base having a fan and said fan causing atmosphere within said cover to circulate about said coils when a treatment gas is backfilled .into said inner cover during annealing.

14. A process for batch coil annealing a plurality of coils of metal strip comprising the steps of:

a) stacking a plurality of coils on a base and covering said coils with a removable inner cover having an annular flange first and second generally concentric elastomer seals circumscribing said flange and in-between said flange and said base to define a generally annular seal space therebetween;

b) drawing a vacuum at first pressure within said seal space for sealing said inner cover to said base;

c) drawing a vacuum at a second pressure higher than said first pressure within said inner cover;

d) backfilling said inner cover with a treatment gas; and e) heating said coils in the presence of said treatment gas to the annealing transformation temperature while periodically varying the second pressure while said coils are being annealed.

15. The process of claim 14 wherein said treatment gas is substantially hydrogen.

16. The process of claim 14 further including the steps prior to step (d) of heating said coils to a preheat temperature of about 500° F. to 600° F. and condensing vaporized hydrocarbons withdrawn by said vacuum within said inner cover by subjecting the withdrawn gas stream from said inner cover to a heat exchanger outside said inner cover whereby said temperature of said withdrawn stream is dropped to a temperature whereat said hydrocarbon vapors are condensed and recovered in a cold trap.

17. The process of claim 15 further including the step of sensing the composition of gas within said seal space and stopping the process should a detrimental quantity of inner cover atmosphere or air leak past either seal.

18. The process of claim 17 wherein should said gas sensed in said seal space be a mixture of hydrogen and air, said process including the additional steps of providing a supply of inert gas and admitting and mixing said inert gas with said hydrogen and air withdrawn under a vacuum from said seal space at a rate coordinated with tile vacuum drawn in said annular seal space sufficient to dilute said hydrogen and air with a sufficient quantity of said inert gas to produce a diluted gas mixture unable to sustain or support combustion when subsequently exposed to further quantities of oxygen at standard atmosphere pressure.

19. The process of claim 18 wherein said treatment gas is heated to an elevated temperature prior to being admitted into said inner cover.

* * * * *

UNITED STATES PATENT AND TRADEMARK OFFICE

CERTIFICATE OF CORRECTION

PATENT NO. : 5,380,378

DATED : January 10, 1995

INVENTOR(S) : Klaus H. Hemsath

It is certified that error appears in the above-indentified patent and that said Letters Patent is hereby corrected as shown below:

Column 14, line 27, change "... gas is backfilled into. said inner" to .... gas is backfilled into said inner"

Column 15, line 2, change " ... at a rate coordinated with tile vacuum" to "... at a rate coordinated with the vacuum"

Column 4, line 10, change"... and thereafter," to "... and thereafter"

Column 12, line 42, "large vacuum area- Typically ..." to "large vacuum area. Typically ...".

Signed and Sealed this

Sixteenth Day of May, 1995

*Attest:*

*Attesting Officer*

BRUCE LEHMAN

*Commissioner of Patents and Trademarks*